United States Patent [19]

Tanaka

[11] 4,154,521

[45] May 15, 1979

[54] AIR FLOW LINE SYSTEM FOR IMAGE FORMING APPARATUS

[75] Inventor: Hidetoshi Tanaka, Musashino, Japan

[73] Assignee: Canon Kabushiki Kaisha, Tokyo, Japan

[21] Appl. No.: 871,847

[22] Filed: Jan. 24, 1978

[30] Foreign Application Priority Data

Feb. 1, 1977 [JP] Japan ..... 52-10015

[51] Int. Cl.[2] ..... G03G 15/00

[52] U.S. Cl. ..... 355/3 R; 355/15; 355/30

[58] Field of Search ..... 355/3 R, 3 SC, 15, 16, 355/14, 30

[56] References Cited

U.S. PATENT DOCUMENTS

| | | | |
|---|---|---|---|
| 3,332,328 | 7/1967 | Roth | 118/655 X |
| 3,901,591 | 8/1975 | Mitsumasu | 355/30 X |
| 3,914,046 | 10/1975 | Tanaka et al. | 355/15 |
| 3,941,471 | 3/1976 | Schatka et al. | 355/30 X |
| 4,040,731 | 8/1977 | Nishikawa | 355/3 SC |
| 4,093,368 | 6/1978 | Nichikawa | 355/15 X |

*Primary Examiner*—R. L. Moses

*Attorney, Agent, or Firm*—Fitzpatrick, Cella, Harper & Scinto

[57] ABSTRACT

An air flow line system is disclosed which is operative effectively and advantageously in such type of image forming apparatus in which the photosensitive medium is in the form of a screen having therein a great number of fine openings. The air flow line system comprises first and second air flow channels or circuits. To switch over the direction of air flow, there is provided a switching device. In accordance with the operating condition of the apparatus, an air flow is directed selectively to the first channel or to the second channel through the switching device. The first channel includes therein the switching device and is defined by an air flow line extending between the vicinity of the screen type photosensitive medium and a pumping device functioning as an air blower or fan. The second channel the switching device and is defined by an air flow line extending between an air using mechanism operative with air flow and the pumping device. When a primary electrostatic latent image is formed on the screen type photosensitive medium, there is formed an air flow toward an ion source of the primary latent image forming means from the screen by the action of the switching device. After forming the primary latent image, the second channel is used to deliver an air flow up to the other operational part which requires such air flow. In this manner, air flow produced by one single pumping device is used for two or more different purposes in the same apparatus. With the air flow line system herein disclosed, a substantial improvement is attainable with respect to the durability of the above mentioned type of image forming apparatus and the quality of image produced thereby.

10 Claims, 14 Drawing Figures

AIR FLOW LINE SYSTEM FOR IMAGE FORMING APPARATUS

BACKGROUND OF THE INVENTION

1. Field of the Invention

The present invention relates generally to an image forming apparatus employing a screen type photosensitive medium (hereinafter referred to as screen) and more particularly relates to an improvement of air flow line system provided within such image forming apparatus.

2. Description of the Prior Art

One example of the screen pertinent to the present invention is a multilayer screen comprising a photoconductive material and an electrically conductive material and, if necessary, further an insulating material, and having a great number of fine openings through which ion stream or the like may be passed.

Such type of screen is used in an image forming process in the following manner.

Initially, a primary electrostatic latent image is formed on the screen by subjecting it to charging and image-wise exposure. Thereafter, a secondary electrostatic latent image is formed on an electrically chargeable member by controlling the ion stream passing through the openings of the screen making use of the electric field formed at the openings owing to the first latent image. The second latent image thus formed on the electrically chargeable member is developed or visualized at the next step for further use of it.

The above described image forming method is known. For example, such image forming process is disclosed in Japanese Patent Application Publication No. 5063/1973 (its counterparts are U.S. Pat. No. 3,645,614 and DOLS No. 1,910,392), U.S. Pat. Nos. 3,647,291, 3,680,954 and 3,986,871.

An important problem involved in this image forming process employing a screen is that the electric resistance of the screen surface is gradually decreased. This is caused by corona discharge made for the screen at the primary latent image forming step. When a corona discharge is applied to the screen, dust and other contaminants in air and various chemical compounds formed by ozone produced during corona discharging such as nitrogen dioxide ($NO_2$), nitrogen monoxide (NO) and ammonium nitrate ($NH_4NO_3$) are deposited on the screen by the corona discharge. These contaminants adhered onto the screen gradually change in quality and/or absorb moisture from the atmosphere and thereby the electric resistance of the screen surface is gradually decreased with time.

Such decrease of the surface electric resistance prevents the screen from being charged up to a sufficient potential. Therefore, the screen having these contaminants deposited thereon can produce only such a primary electrostatic latent image having a reduced potential or lowered electrostatic contrast. As a result, the quality of image finally produced becomes deteriorated.

As a solution to the problem, it may be considered that the contaminants are to be removed mechanically. But, since the screen is extremely thin and soft, it is difficult to apply to the screen directly a cleaning means as usually used in an electrophotographic apparatus.

An effective approach to solve the problem is to form an air stream flowing toward the side of corona discharger passing through the screen at the time of charging during which the contaminants are most apt to deposit onto the screen. The flow of air toward the corona discharger prevents dust and other contaminants from depositing on the screen.

Another possibility to prevent the screen from being contaminated with dust and the like is to keep the air in the vicinity of the corona discharger substantially free from dust and the like.

These conceptions of use of air flow have already been realized in an image forming apparatus employing a screen. For example, such image forming apparatus in which air flow is used to prevent the contamination of the screen is disclosed in Our U.S. application Ser. No. 729,692, U.S. Pat. Nos. 3,936,184 by Yujiro Ando et al. and 4,040,731 by Masaji Nishikawa. These prior inventions were all made to solve the above described problem.

To prevent the contamination of a screen with dust, however, it is not always necessary to continuously form an air flow toward the discharger all the time during which the image forming apparatus is in operation. The deposition of dust on the screen must be prevented by flowing air toward the discharger at least only when the latter is in operation.

On the other hand, the image forming apparatus employing a screen often includes such means and part which also require an air flow or are operative with air flow, in addition to the above mentioned primary latent image forming part. Examples of such air using means and part are a sheet separating and conveying mechanism for separating a transfer sheet carrying thereon a secondary latent image from a related drum using a back pressure, a mechanism disposed in the vicinity of the developing means for preventing the scatter of developer using an air flow, a cooling air stream generating mechanism disposed for the fixing means and driving source, and an ozone treating mechanism for decomposing ozone accumulated within the apparatus due to corona discharge.

In all the known image forming apparatus of the type employing a screen, no measure is adopted to fully control the air flow throughout the apparatus even though only an air flow for the screen is taken into consideration. Therefore, air is flown unnecessarily in the apparatus, which results in reduction of operational efficiency of the apparatus and also may cause the problem of noise.

SUMMARY OF THE INVENTION

Accordingly, it is an object of the invention to provide an image forming apparatus which enables to produce a good quality image using a screen.

It is another object of the invention to provide a high efficient air flow control system for the image forming apparatus employing a screen.

It is a further object of the invention to form a good image and to make a high efficient air flow control system.

A still further object of the invention is to improve the durability of the screen and to provide an image forming apparatus in which the control of air flow can be carried out in a very simple manner.

A still more specific object of the invention is to provide an air flow line system in which an air flow toward the corona discharger side passing through the screen is formed at the primary electrostatic latent image forming step during which the contaminants as mentioned above are most apt to deposit on the screen and when a seconary electrostatic latent image is formed and the air flow for the screen becomes unnecessary, the air flow is delivered to other air using means so that the air flow produced from an air blowing means may be used with high efficiency and in a stable manner.

In order to attain the above objects according to the invention, there is provided an air flow line system comprising a first air flow channel extending between the vicinity of the screen and an air blowing means (hereinafter referred to as a pumping means) through a switching means and a second air flow channel extending another air using mechanism or means and the pumping means through the switching means. The switching means switches over the air flow selectively to the first channel or to the second channel in such a manner that when a primary electrostatic latent image is formed on the screen there is formed an air flow flowing toward the ion source of the primary latent image forming means from the screen by way of the first channel and after forming the primary latent image the air flow is directed into the second channel. With this air flow line system, the image forming process proceeds while using the air flow produced by one single pumping means for two or more different purposes.

Examples of another air using mechanism or means include a suction mechanism for sheet separating means, a compressed air blowing nozzle for separating means, cooling means for parts unintentionally heated by fixing means and the like, ozone decomposing means and suction means for conveying mechanism of a second latent image carrying sheet material or conveying mechanism for transfer sheets.

The type of pumping means and the arrangement of air flow channel are not limited only to those as illustrated in the following embodiments. The pumping means is used not only to form a flow of suction air but also to form a flow of compressed air. The structure and arrangement of the screen and the process for forming latent images do not constitute any essential part of the present invention.

According to the invention, one single pumping means is used for different purposes at different times in response to the operational phase of the apparatus and therefore the pumping means can be used very effectively. Compared to the case where plural pumping means are used for every purpose, the interruption of operation of the pumping means is very few in the system of the invention. Therefore the air flow obtained therefrom is stable, which assures a smooth operation of the apparatus.

Other objects, advantages and features of the invention will become more apparent from the following detailed description considered together with the drawings.

DETAILED DESCRIPTION OF THE PREFERRED EMBODIMENTS

Figure 1:
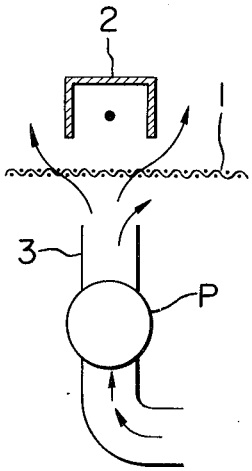
FIGS. 1, 2(A) and 2(B) are schematic illustrations showing an air flow toward the corona discharger from the screen side respectively.
Figure 2A:
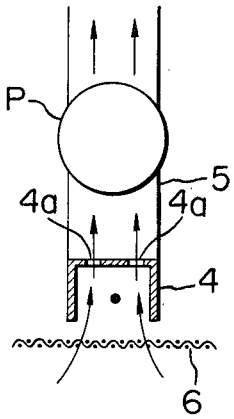

FIG. 1 schematically shows a manner of producing an air flow at the charging position of a screen. There are two alternative methods used for producing an air flow toward the discharge electrode of corona discharger at the opening part of the screen. According to the method illustrated in FIG. 1, a compressed air from an air pumping means P is positively blown into the side of a corona discharger 2 through the screen 1 by way of a pipe 3. The other method is that as illustrated in FIGS. 2(A) and (B). In this case, the pumping means P is provided on the same side as the corona discharger 4 is disposed. Air in the vicinity of the discharger 4 is sucked by a pipe so as to form an air flow toward the discharger at the opening part of the screen 6. The air flow thus produced is indicated by the arrows in FIGS. 2(A) and (B). The discharger 4 of FIG. 2(A) has a backside shield plate provided with openings *4a* through which the air flow is drawn in case of 2(B) the air flow is drawn in turning round the outside of the shield plate of the discharger 4.

Generally the screen is so designed that its chargeable layer such as an insulating layer or a photoconductive layer faces the corona discharger for forming a primary latent image. Therefore, a deposition of contaminants on the screen surface is caused by corona discharge.

The above described air stream flowing toward the discharger through the screen is required only when a primary latent image is formed. After the latent image was once formed, the air stream becomes no longer necessary. On the other hand, there is a case where an image forming apparatus includes such operative means which operates with air stream after the formation of a primary latent image. For example, such type of image forming process is known in which a secondary latent image is formed on an intermediate image carrier such as an insulating drum using the previously formed primary latent image and after developing the secondary image, it is transferred to a transfer material, which is then used as a copy. In this process, the transfer material is heavily drawn to the intermediate image carrier electrostatically at the transferring step which is usually carried out electrostatically. Therefore, there is a need of separating the transfer material from the carrier employing a suitable separating means such as stripping pawl or belt. However, when the image forming process is speeded up, there occurs a case where an air pressure stream may be used preferably as a separating means for effecting a separation and transportation of the transfer material reliably.

For such type of image forming apparatus which has a screen as photosensitive medium and in which an air pressure stream is used as a transfer material separating means, therefore, there are two operative parts which require the flow of air. To satisfy the requirement, a most effective use of the pumping means is desired as a generating source of the necessary air flows. It is understood that the screen requires an air flow during the primary latent image being formed and the separating means requires an air stream after the secondary latent image is formed. Since these two parts use air flow at different time from each other, an efficient use of the pumping means may be attainable by switching over the air flow channel in accordance with the proceeding of the image forming steps.

Figure 3:
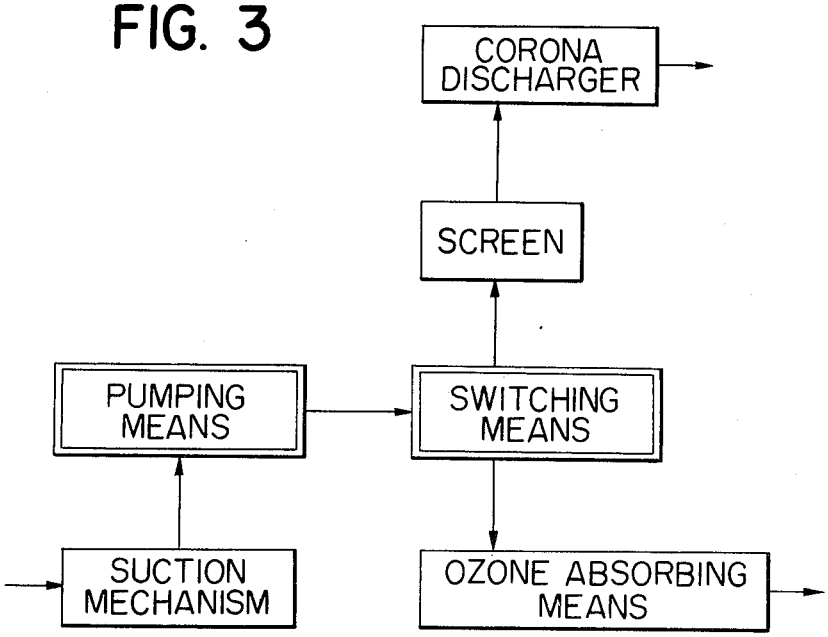
FIGS. 3 through 5 are schematic illustrations showing various embodiments of the invention.
Figure 4:
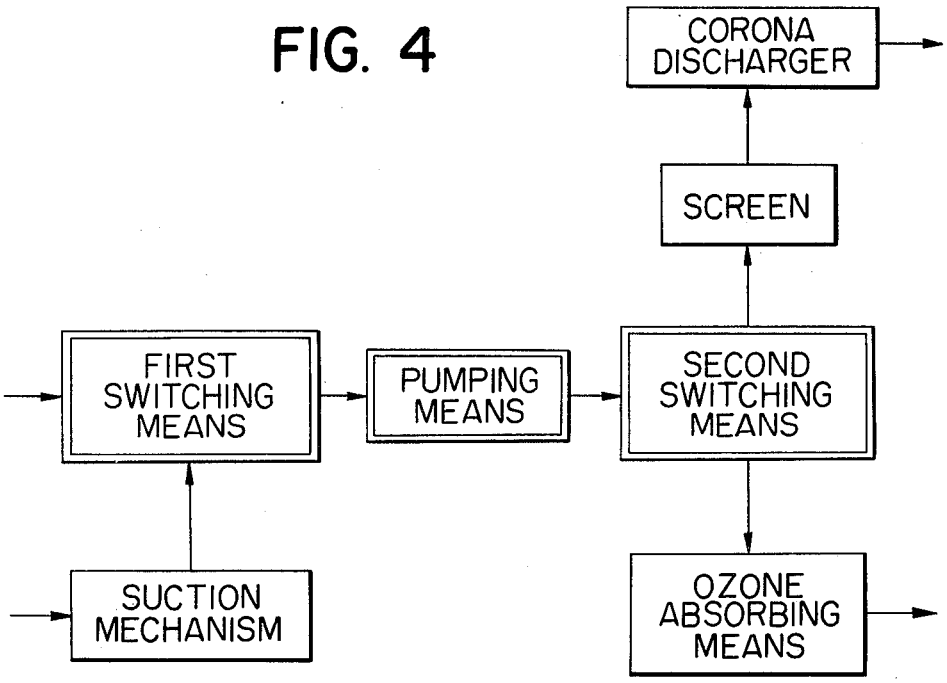
Figure 5:
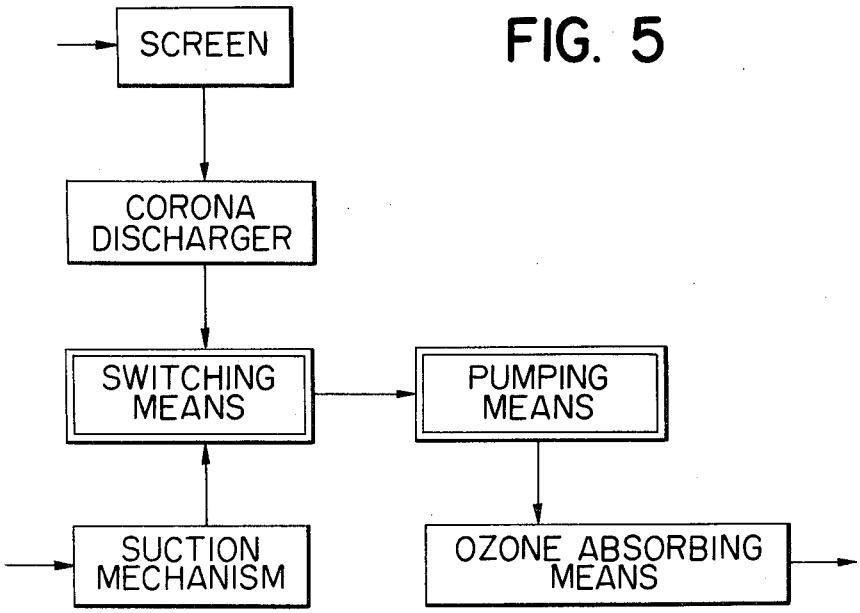

FIGS. 3 through 5 diagrammatically show various embodiments of air flow line system of the invention. In each the diagram, each operative means or member is indicated by a block and the direction of the flow of air is indicated by arrow. The embodiment of FIG. 3 corresponds to the arrangement of FIG. 1 mentioned above in which an air flow is positively blown into the discharger side from the screen side. The pumping means sucks air from the suction mechanism of the separating means and sends it to the ozone absorbing means of air treatment mechanism or to the screen through a switching means. Herein, "ozone absorbing means" should be understood as means used for decomposing ozone produced in the apparatus, employing active carbon or catalyst. The ozone absorbing means is optionally provided when necessity arises. Also, dust removing means and heating means are optionally provided, if necessary, to keep the screen in a more dust-free state and to increase the electric resistance under a reduced humidity.

In the embodiment of FIG. 3, it is not always necessary to switch over the air flow channel from one to another. Air may be directed toward both of the screen and the ozone absorbing means. By doing so, air flow can be applied to the screen as well as to the separating means using only one single pumping means. However, in this case there occur a drop of air pressure acting on the screen and a pressure drop of suction air at the separating means because of pressure loss caused by blow-out of air flow at the ozone absorbing means in the air flow line. This problem may be solved by increasing the capacity of the pumping means. But, if the switching means is omitted and air is continuously flown to both of the screen side and the ozone absorbing means side in this manner, then there occurs a considerable waste of operation in view of the fact that no suction force is required for the separating means when a primary latent image is formed. Moreover, for the process of retention copy in which ionic modulation is carried out many times using a single primary latent image to form an image, there is no need of producing a primary latent image on the screen during the copying and therefore no blowing of air to the screen is required. The above mentioned continuous blow of air to the screen without using any switching means may be said effective in the sense of prevention of dust deposition onto the screen for such type of apparatus in which only one modulation is carried out with a single primary latent image and the formation of primary latent image and the operation of separating means are successively carried out in times close to each other for making copies continuously.

The embodiment of FIG. 4 is an improvement of FIG. 3 embodiment. To minimize the pressure loss occurred at the blow-out side, two switching means are provided in the air flow channel. According to the embodiment, the pumping means can be used more effectively. Namely, at the time of a primary image being formed, an air flow is used to prevent the deposition of dusts and other contaminants in the manner shown in FIG. 1. To this end, the switching means is brought to the position in which there is formed an air flow flowing passing through "first switching means" — "pumping means" — "second switching means" — "screen" — "corona discharger" in this order (Circuit A). On the contrary, when the separating means is brought into operation, there is formed another air flow flowing passing through "suction mechanism" — "first switching means" — "pumping means" — "second switching means" — "ozone absorbing means" in this order (Circuit B). In case of the apparatus of FIG. 4, the part of the circuit A downstream side of "pumping means" constitutes the first circuit of air flow and the part of the circuit B upstream side of "pumping means" constitutes the second circuit for air flow. The overall apparatus is formed by connecting the first and second circuits in series. As can be noted from FIG. 4, during the time when an air blowing to the screen is required, the first switching means at the suction side (at the side of the separating means) takes a position to have air sucked directly by the pumping means without passing through the separating means, so that the amount of air blown at the blow-out side may be increased.

On the contrary, when no primary image is formed and instead the separating means is brought into operation, the second switching means may be actuated to switch over the flow of blowing air from the screen side to the ozone absorbing means side so that the operation of ozone decomposition can be carried out at the blow-out side. It is a matter of course that when the separation of transfer material and the formation of primary image are carried out simultaneously, air is blown into the screen side.

Figure 2B:
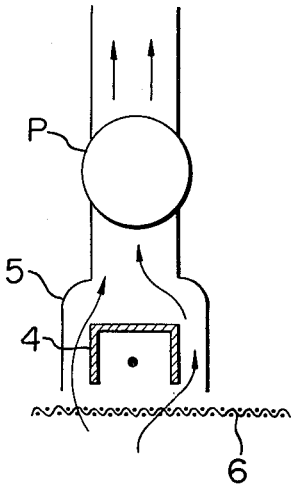

FIG. 5 illustrates another embodiment in which the air flow is drawn from the side of the corona discharger as shown in FIG. 2 to form an air stream flowing from the screen toward the corona discharger. According to the embodiment of FIG. 5, there is formed an air flow line most suitable for an image forming apparatus of the type in which retention copying is carried out.

The suction side of the apparatus of FIG. 5 is switched over by the switching means in such manner that it can work only for a one way suction mechanism relative to the suction mechanism for the separating means and that for the corona discharger opposed to the screen. For example, when a primary image is to be formed on the screen, there is formed an air flow flowing passing through "screen" — "corona discharger" — "switching means" — "pumping means" — "ozone absorbing means" in this order. On the contrary, when no primary image is to be formed and instead only the separation of transfer material is carried out, there is formed an air flow flowing passing through "suction mechanism for separating means" — "switching means" — "pumping means" — "ozone absorbing means" in this order.

In this manner, a single pumping means is used for two different purposes making use of time difference between operational steps requiring an air flow. Therefore, it is allowed to make a full use of the capacity of the single pumping means like the case of FIG. 4 embodiment described above. Furthermore, in the embodiment of FIG. 5, there is used only one switching means, which will bring forth additional advantages such as easy control, low manufacturing cost and better use of the space in the apparatus.

As will be understood from FIG. 5, the air flow line of "screen" — "corona discharger" — "pumping means" constitutes the first channel of the invention whereas the air flow line of "suction mechanism" —

"switching means" — "pumping means" constitutes the second channel.

The combination of pumping means, switching means and air flow channels as described above makes it possible to use the pumping means fully and effectively and therefore contributes to the reduction in weight and size of the apparatus and to the reduction of noise.

Now, the present invention will be described referring to some examples of image forming apparatus in which the present invention is embodied. While in the above description, the suction mechanism has been shown and described particularly as to be a suction mechanism for the transfer material separating device such as a suction box, it is to be understood that the suction mechanism is not limited to such one only but may be replaced by any other suction mechanism provided to use for another purpose such as prevention of developer being scattered as will be mentioned hereinafter or for an ozone decomposing means. The suction mechanism mentioned hereinbefore and hereinafter should be understood as such operative means which operates making use of air flow produced by a suction force.

Figure 6:
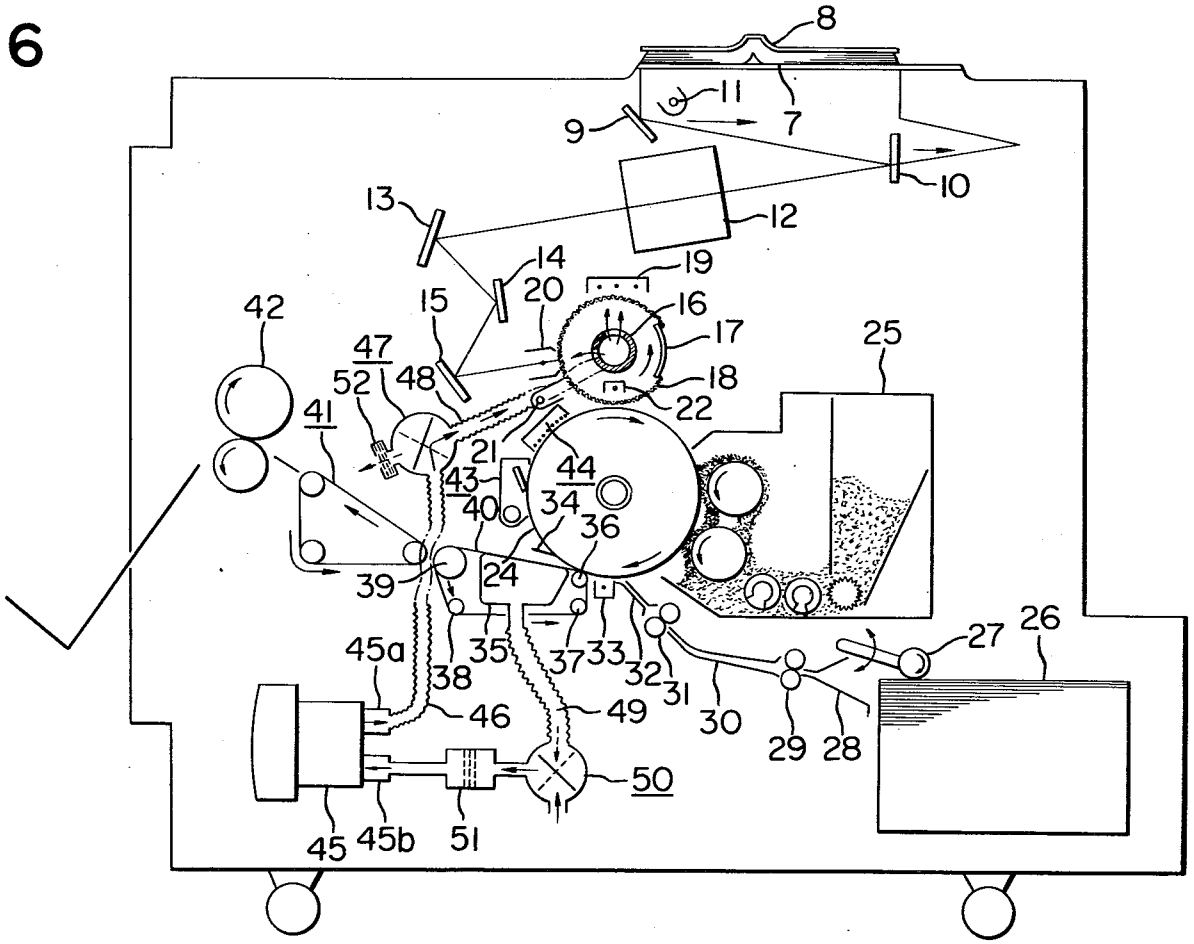
FIG. 6 is an explanatory view in section showing an example of image forming apparatus in which the present invention is embodied.

Now, referring to FIG. 6, there is shown a copying apparatus in which a copied image is formed employing a screen type photosensitive medium at a high speed. The apparatus has a glass plate 7 on which an original 8 which may be a bulky volume as illustrated in the drawing, is laid on. Under the glass plate 7 there are disposed two mirrors 9 and 10 which are moved in the direction of arrow in the velocity ratio of 2:1. One of the mirrors, that is, the mirror 9 scans the original 8 moving together with an illumination lamp 11. The image of the original illuminated by the lamp 11 is reflected to the other moving mirror 10 which is moved in the direction indicated by the arrow at the speed of one-half of that of the mirror 9. The image reflected by the mirror 10 is projected onto the screen 18 through a projection lens 12 and stationary mirrors 13, 14 and 15. The screen 18 is wound on a rotary frame 17 into a shape of cylinder. The frame is rotatable about its shaft 16 in the direction of arrow. As to shaping of the screen into a cylinder, a detailed explanation has been made in Japanese Patent Application laid open No. 129231/1975 specification, U.S. pat. Nos. 3,985,432 and 4,044,671 specifications. The screen 18 comprises an electrically conductive member, a photoconductive layer laid thereon and a top surface insulating layer. Further detailed description of the structure of such a screen can be seen in our specification of Japanese Patent Application laid open No. 341/1976, U.S. application Ser. No. 771,309, U.S. Pat. Nos. 2,945,725 and 3,986,871. Therefore, herein any further description thereof is omitted.

The screen 18 is laid on the frame 17 with its surface insulating layer being on the upmost outside of the cylinder. As the cylindrical screen rotates in the direction, it passes through a primary corona discharger 19, a secondary corona discharger 20 and a whole surface illumination lamp 21 successively so that a primary electrostatic latent image corresponding to the original image is formed on the screen in a well-known manner.

After the primary latent image being formed, the screen further continues to rotate in the direction of the arrow and reaches the position of a corona discharger 22 stationarily provided within the cylindrical screen. The corona ion from the corona discharger 22 is modulated by the screen so as to form a secondary electrostatic latent image on a drum 24 which has a surface insulating layer and rotates about its axis 23 in the direction indicated by the arrow. Then, the secondary latent image is developed with toner particles by a developing device 25.

In order to receive the developed image on the drum 24, a sheet of transfer material is fed to the transferring position by means of guides 28, 30 and 32 and feeding rollers 29 and 31 from a sheet supplying table 26 using a pick up roller 27 and a sheet separating member (not shown). The transfer sheet is transported to the transferring position (station) in timing with the developed image and a bias voltage is applied to the transfer sheet by a corona discharger 33 so as to transfer the toner image onto the transfer sheet.

At the step of transferring, the transfer sheet is apt to firmly adhere onto the surface of the drum electrostatically due to the discharge of the corona discharger 33. Therefore, in order to initiate the separation of the transfer sheet from the drum there is used a stripper pawl 34. After the fore edge portion of the sheet being stripped from the drum by the action of the pawl 34, the transfer sheet is drawn by a suction box 35 disposed under the stripper pawl 34 and is received by a porous belt 40 which extends round rollers 36, 37, 38 and 39 and rotates around the suction box 35. The transfer sheet separated from the drum and received by the endless porous belt 34 under the suction force of the suction box 35 is then transferred to another conveyor belt 41 which transports the sheet to a fixing device 42. At the fixing device 42, the developed image on the transfer sheet is fixed and now all the steps of copying process is completed so that the sheet may be discharged out of the apparatus.

After transferring, any residual toner left on the drum 24 is removed by a cleaning means 43. Before entering the secondary latent image forming step, the drum is further charged or discharged so as to make the potential on the drum uniform all over the surface.

In the apparatus described above, the developing device 25, transfer sheet supplying table 26, the separating means provided with the stripper pawl 34 and the suction box 35 and the fixing device 42 may be conventional ones hitherto used in an electrophotographic copying machine.

The use of a photosensitive screen as described above enables to form a number of secondary electrostatic latent images repeatedly using only one primary electrostatic latent image. Therefore, when retention copying is carried out in the apparatus, it becomes unnecessary to continue operating the optical means and the corona discharger for forming a primary latent image. This means that the copying process allows to leave the time otherwise required for the formation of primary latent image out of consideration. Accordingly, with the apparatus illustrated in FIG. 6, a considerable speed up of image forming can be attained compared with apparatus by which a primary latent image and a secondary latent image are to be formed alternatively.

In the embodiment of FIG. 6, air blown out from the opening of the hollow shaft 16 about which the screen rotates is used to prevent dust and other contaminants from accumulating on the screen. More particularly, the hollow shaft 16 is provided openings directed to the corona discharger. A stream of compressed air introduced into the shaft by the pumping means is blown out from the openings toward the corona dischargers 19 and 20 passing through the screen. As a result, deposition of dust and other contaminants onto the screen can be prevented for the reasons previously described in connection with FIG. 1. Since the air flow used for this purpose must have a sufficiently high pressure and a sufficiently large volume, a blower 45 is used as a compressed air generating means for the stationary hollow shaft 16. The blow-out side 45*a* of the blower 45 is connected to a hose 46 forming an air flow line the other end of which is connected with a second switching means 47. The switching means directs the air flow to the shaft 16 or to the ozone absorbing means 52 selectively. In this manner, the compressed air delivered from the blower 45 can be sent selectively to the stationary shaft 16 or the ozone absorbing means 52 in response to the set position of the switching means 47. The reference numeral 48 designates a pipe for connecting the shaft 16 with the switching means 47.

The suction side 45*b* of the blower is connected to a pipe 49 through a first switching means 50 and a filter 51 interposed therebetween. Another end of the pipe 49 is connected with the suction box 35 for the separating means mentioned above. In accordance with the set position of the switching means 50, the suction side of the blower 45 can take in air selectively from the suction box 35 or directly through the switching means communicating to the air within the apparatus. The filter 51 interposed between the switching means 50 and the blower 45 serves to filter off the dust contained in the sucked air and thereby prevents the dust and other foreign matters from being accompanied to the screen 18. The filter may be disposed between the switching means 47 and the hollow shaft 16. Also, a suitable heating means such as a heater may be provided in the air line leading to the hollow shaft so as to deliver heated air to it. By doing so, the screen 18 is heat dried and the electric resistance of the screen surface is increased, which assists in forming a latent image of high potential. Furthermore, by keeping the screen warm with the heated air, the characteristic of the screen may be made stable.

The manner of operation of the above described apparatus is as follows:

Initially explanation will be made of the operation during the step of primary latent image forming. During this step of the process, each the switching means 47, 50 is in the position indicated by the solid line in the drawing of FIG. 6. In this position of the switching means, air is taken in from the first switching means 50 and after separating dusts from the air by the filter 51, the sucked air is flown into the blower 45. The blower blows out an air flow into the hollow shaft 16 through the second switching means 47. The air introduced into the shaft is blown out from its openings toward the corona dischargers 19 and 20 passing through the rotary screen 18. This flow of air is indicated by the solid line arrows in the drawing.

In this manner, during the step of primary latent image forming at which the corona dischargers 19 and 20 conduct discharging, there is produced a stream of blowing air flowing from the inside of the screen toward the corona dischargers and thereby it is prevented that the screen is contaminated with dusts and other contaminants due to the corona blast produced during discharge of the corona dischargers 19 and 20.

After forming the primary latent image, the switching means 47 ad 50 are switched over from the positions indicated by the solid line to the positions suggested by the dotted line in the drawing, respectively. The dotted arrow shows the air flow line formed in this position of switching means. Namely, air is taken in from the suction box 35 disposed for the separating means and flows into the blower 45 through the first switching means 47 and the filter 51. The air blown out from the blower 45 passes through the second switching means 50 and the ozone absorbing means 52, and finally it is discharged into the interior of the apparatus. When the discharged air flow is not heated, it may be used to cool the atmosphere in the vicinity of the fixing device 42.

As will be understood from the foregoing, by switching over the air flow line as described above according to the invention, the possible pressure loss in every parts of the apparatus can be minimized and therefore a most efficient use of air flow in the apparatus can be attained. Moreover, since a single blower can be used for one purpose during a certain particular time period and for another purpose during another time period, it becomes possible to use a blower of relatively small capacity, which in turn gives a possibility of substantial reduction in size of the apparatus and also of reduction of noise generated by it.

Now, some application forms of the invention will be described in detail referring to the drawings showing the related parts of the above described apparatus.

Figure 7:
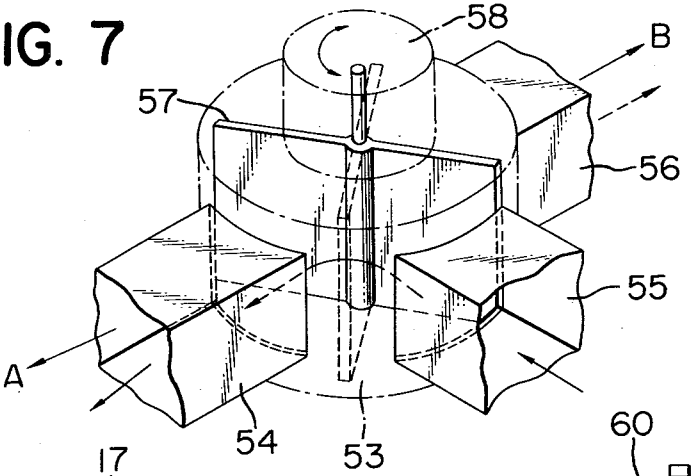
FIG. 7 is a perspective view of the switching means used in the apparatus shown in FIG. 6.

FIG. 7 shows one embodiment of the switching means in detail. Reference numeral 53 designates a cylindrical box on the circumference of which there are connected three pipes 54, 55 and 56. Within the box 53 there is disposed a partition plate 57 rotatable around the center of the inner wall of the box. To move the partition plate 57 from its one position indicated by the solid line to another position suggested by the dotted line and vice versa, there is provided a rotary solenoid 58 which is driven by an electrical signal. By switching over the position of the partition plate in this manner, the flow of air coming from the pipe 55 and passing through the switching means is switched over from the direction of A to B and vice versa. More concretely, when the partition plate is in its solid line position, the flow of air flown therein from the pipe 55 flows out into the pipe 54 whereas in the dotted line position of the plate the flow of air flows out into the pipe 56. With this switching means, an easy switching over the air flow is possible.

As slight modifications of the above embodiment, holes of suitable size may be provided in the partition plate 57 or the switching positions thereof may be set in such a manner that the plate may partially close the pipe line. This allows a reduced amount of air to flow in both the pipes at the same time if it is desired. For example, by delivering this reduced amount of air flow continuously to the side of the screen, any deposition of dusts on the screen can be prevented always even the time other than corona discharging.

Figure 8:
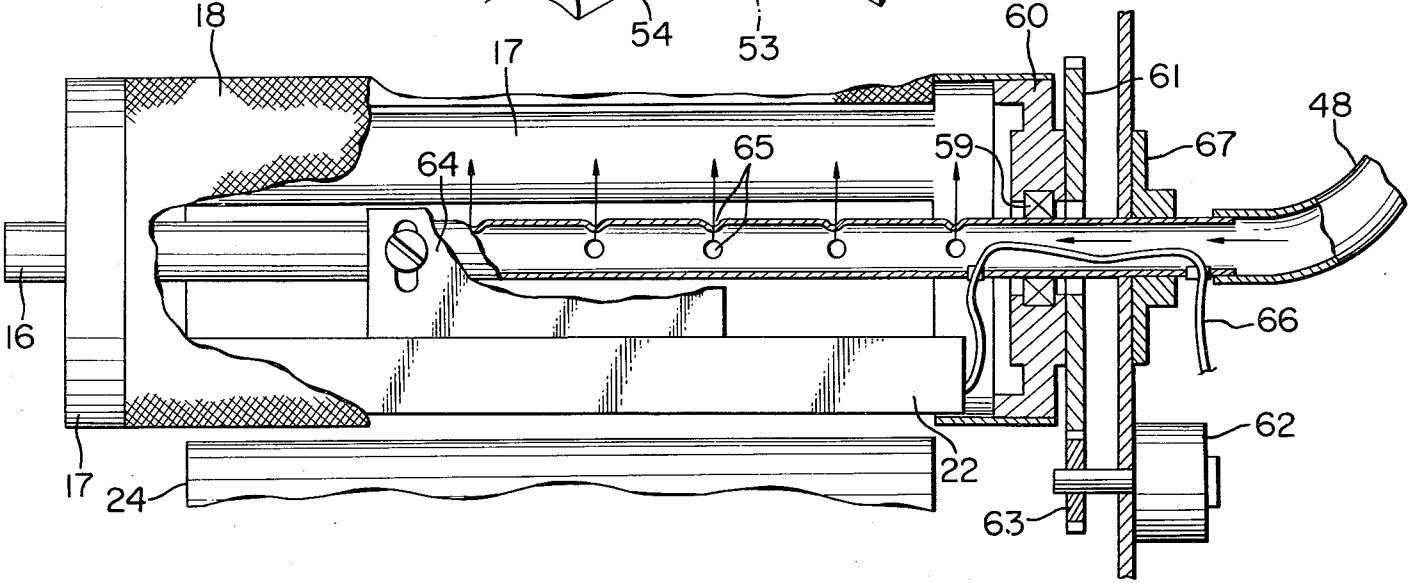
FIG. 8 is a partial sectional view of the screen part used in the apparatus shown in FIG. 6.

FIG. 8 shows the part of screen rotating mechanism provided with the air blowing openings in partial section.

The hollow shaft 16 is fixed to the body of the apparatus. On the both ends of the shaft there are provided flanges 60, 60 (only one is visible in the drawing) which support the frame 17 for the screen 18 through rotary bearings 59, 59. On the flange 60, a gear 61 is secured unitarily. The gear 61 is in mesh with a gear 63 driven by a motor 62 so as to rotate the screen 63. Within the cylindrical screen, the corona discharger 22 for ion modulation is mounted on the shaft 16 by means of an achoring member 64.

An air flow is introduced into the hollow shaft 16 from the pipe 48 through either one or both of the ends of the shaft. The air introduced in the shaft is blown out from the openings 65 provided in the wall of the shaft directed to the related corona dischargers (not shown). The air blown out from the openings flows toward the corona dischargers passing through the screen. In the drawings of FIG. 8, the reference numeral 66 designates a power source line for the corona discharger 22 and 67 is a bearing for the hollow shaft 16.

As can be noted in FIG. 8, there is no air flow directing to the corona discharger 22 passing through the screen. As described in the above mentioned our U.S. application Ser. No. 729,692 specification, this is because deposition of contaminant on this side cannot have any adverse effect on image forming when the side of the screen 18 facing the corona discharger 22 is electrically conductive. The deposition of contaminants on the screen generally has an effect to make the screen electrically conductive. Therefore, when the surface portion on which the contaminants are deposited, is originally electrically conductive, the deposition of the contaminants on such surface portion of the screen cannot have any adverse effect on the screen. For the reason, it is unnecessary to blow out air toward the corona discharger 22 through the screen.

Figure 9:
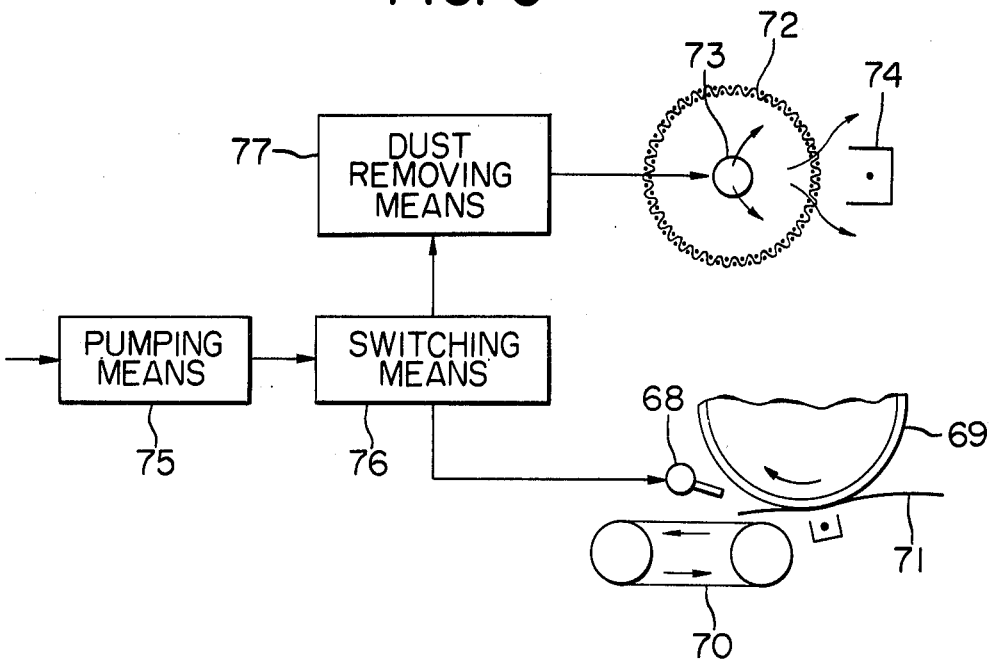
FIGS. 9 through 11 are schematic illustrations showing other embodiments of the invention.

FIG. 9 illustrates another embodiment of the invention regarding air flow channel.

In this embodiment, the procedure shown in FIG. 1 is employed to prevent dust from depositing on the screen while employing an air blow type of separation different from the suction type separation shown in FIG. 6 for separating a transfer sheet from the drum. The reference numeral 68 designates a nozzle for blowing air to a transfer sheet to be separated from the insulating drum 69. The air blowing nozzle 68 may be of the type as described in detail in the specifications of Japanese Patent Application Publication No. 19758/1967 and U.S. Pat. No. 3,506,259.

The transfer sheet 71 is stripped from the insulating drum 72 after a toner image carried on the drum being transferred onto the transfer sheet. An endless rotary belt 70 receives the separated sheet and conveys it to the fixing station in a manner as previously described. 72 is a screen in a shape of drum, 73 is a hollow shaft provided with air blowing openings as described above with reference to FIG. 8, 74 is a corona discharger, 75 is a pumping means such as a blower and 76 is switching means. 77 is a dust removing and heating means the provision of which is optional. The arrows in the drawing again indicate the flow line of air.

In the arrangement of FIG. 9, when a primary electrostatic latent image is formed on the screen, the switching means 76 is in a set position in which air flows from the pumping means 75 to the screen 72. After forming the primary latent image, the switching means 76 is switched over into its another position in which air is delivered to the nozzle 68 to effect separating the transfer sheet from the drum.

In this embodiment, the part of air flow line of "pumping means" — "switching means" — "screen" constitutes the first air flow channel of the invention and the part of "pumping means" — "switching means" — "nozzle 68" constitutes the second channel.

It is of course possible to use a portion of air flow toward the nozzle for cooling the atmosphere in the vicinity of the ozone absorbing means and the fixing means which are apt to raise up the temperature of the atmosphere unfavorably.

Figure 10:
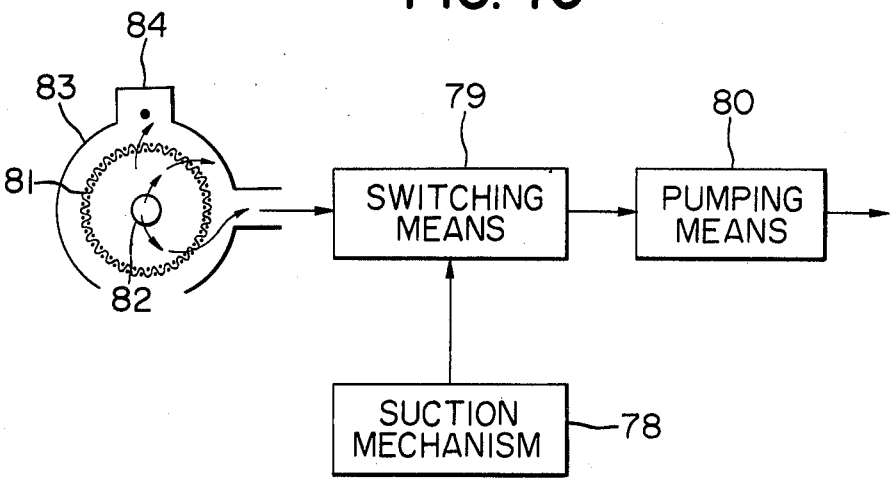

FIG. 10 shows a still further embodiment of the invention in which the procedure shown in FIG. 2 is employed to prevent dust and other contaminants from depositing on the screen.

In the drawing of FIG. 10, the reference numeral 78 designates a suction box for separating means as described above with reference with FIG. 6, 79 is a switching means, 80 is a pumping means, 81 is a screen in a shape of drum, 82 is a stationary shaft disposed within the screen, 83 is a duct for the screen and 84 is a corona discharger. In this embodiment, for the stationary shaft 82 there is not provided any means for positively blowing out air toward the discharger 84 through the screen 81. The duct 83 serves also as a dust cover for the screen in addition to its ordinary function as a duct.

In this embodiment, when a primary electrostatic latent image is formed, the switching means is in a position in which the pumping means 80 takes in air from the inside of the duct 83. As a result of the suction, air is effused from the openings provided in the shaft 82 and there is formed a flow of air flowing toward the suction side passing through the screen. This means that air flows from the screen to the corona discharger and dusts are prevented from depositing on the screen during corona discharging.

After forming the primary latent image, the switching means 79 is switched over into another position in which the pumping means takes in air from the suction box 78 so as to actuate the separating means.

Also in case of this embodiment, it is possible to provide an ozone absorbing means at the blow-out side of the pumping means 80 or to use the air blown out therefrom for cooling as mentioned above.

In this embodiment of FIG. 10, the part of air flow line of "screen 81" — "switching means 79" — "pumping means 80" constitutes the first channel of the invention and the part of "suction box 78" — "switching means" — "pumping means" constitutes the second channel.

Figure 11:
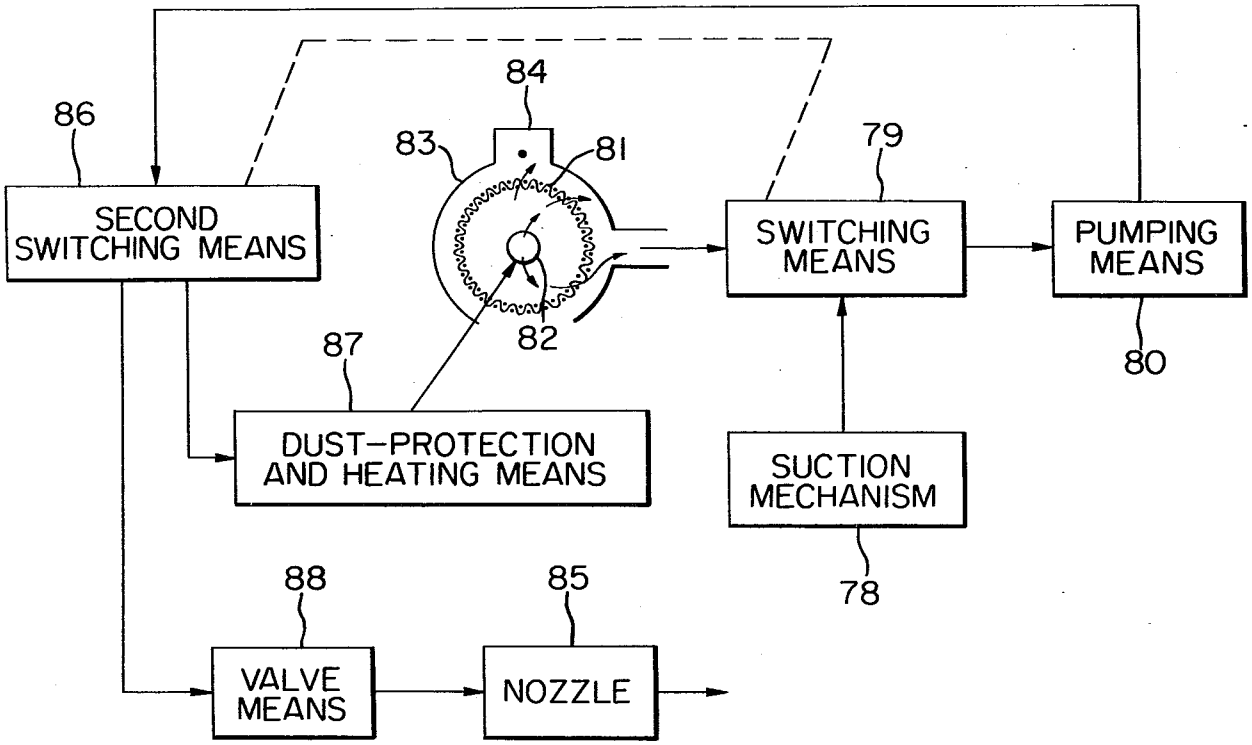

FIG. 11 shows a modification of the above described embodiment of FIG. 10. The feature of this modification resides in that the air from the pumping means 80 is fed to both of the hollow shaft 82 and the nozzle 85. The hollow shaft is disposed within the screen and provided with air blowing openings. The nozzle 85 is of the type as described with reference to FIG. 9. The flow of air flowing into the nozzle is controlled by a valve means 88. To this end, there is provided a second switching means 86 operative in timing with the above described switching means 79. If necessary, a dust removing and heating means 87 may be disposed between the second switching means 86 and the shaft 82 as illustrated in the drawing. This arrangement assures a sufficient flow of air toward the corona discharger from the inside of the screen at the step of primary latent image forming and enables to omit a stripping pawl as used in the embodiment of FIG. 6 for separating the transfer sheet from the drum.

Figure 12:
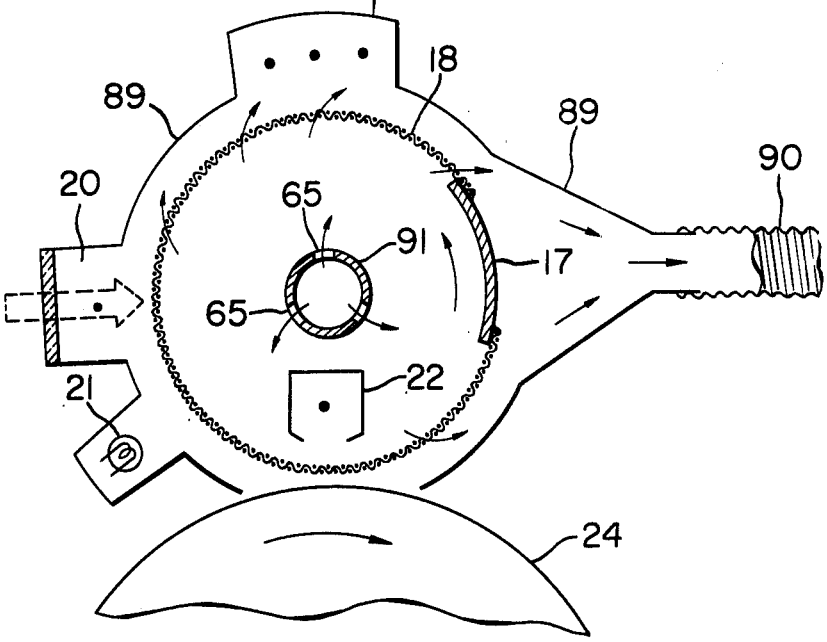
FIG. 12 shows the concrete arrangement of a screen and a member surrounding it based upon the embodiments of FIGS. 10 and 11.

Another embodiment illustrated in FIG. 12 is a combination of the embodiments shown in FIGS. 6 and 10.

In the drawing of FIG. 12, the parts and members corresponding to those of the apparatus shown in FIG. 6 are designated by the same reference numerals as used in FIG. 6.

A duct 89 encloses the screen 18 in a shape of drum in such manner as not to prevent the rotation of the screen.

To a portion of the duct 89 there is connected a pipe 90 used for suction. For the suction, a shaft 91 about which the screen 18 rotates can be used to flow air. Alternatively, openings may be provided in the flange 60 (FIG. 6) to lead the air.

Figure 13:
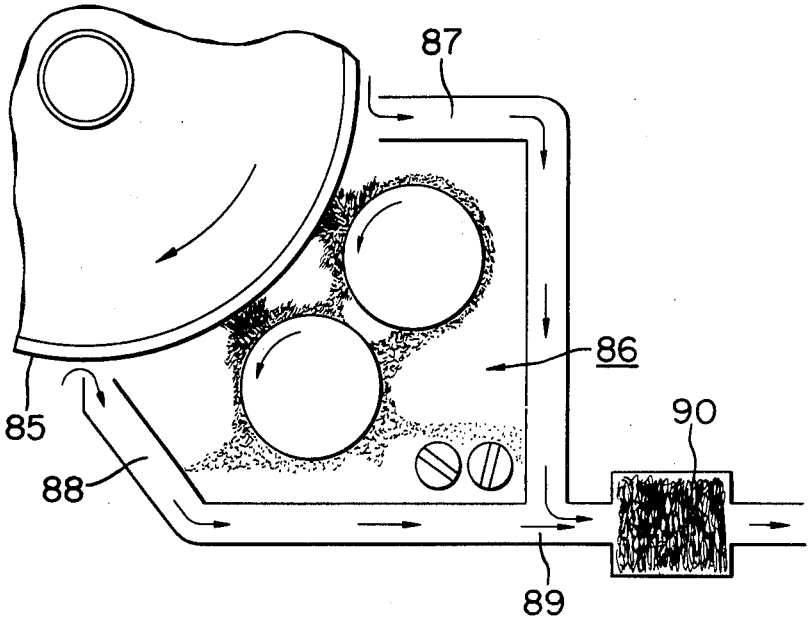
FIG. 13 is a schematic illustration showing means for preventing the scatter of developer as an air using means.

FIG. 13 shows an arrangement of mechanism commonly adoptable for preventing the scatter of developer. The mechanism is disposed at the suction side of the pumping means. The reference numeral 85 designates an insulating drum carrying thereon a secondary latent image and 86 is a developing station wherein a conventional dry developing is effected. At the inlet side of the developing device 86 there is provided a duct 87 and at the outlet side there is another duct 88. These ducts open toward the shaft of the drum 85 and meet each other at 89. The joined part extends to the suction side of the pumping means and is connected therewith through a switching means. When the switching means is actuated so as to have the air sucked from the ducts 87, 88, there is formed a flow of air flowing in the direction of arrows. As a result, the scattered developer is taken into the ducts 87, 88. The air flow containing the developer enters the pumping means after it being filtered through a filter means 90.

As will be understood from the foregoing, the present invention brings forth remarkable advantages for operation of such type of image forming apparatus in which a photosensitive medium in a form of screen is used. A single pumping means provided in the apparatus can be used for dual purposes, that is, for removing dusts and other contaminants at the primary latent image forming step on one hand and for separating the transfer sheet from the drum and/or cooling the unfavorably heated air on the other hand. Since these two steps require a flow of air in different time from each other, the single pumping means can be used to deliver an air flow to the first air flow channel or circuit for one air using location for one time and to deliver an air flow to the second air flow channel or circuit for another air using location for another time independently of each other. This assures a smooth operation of the apparatus as a whole. Furthermore, when it is desired, an air flow may be divided into the first and second air flow channels to flow air through both the channels at the same time using the single pumping means. Therefore, it is no longer necessary to provide a plural number of pumping means in the apparatus or to increase the capacity of each pumping means. This makes it possible to reduce the noise generated by pumping means and also reduce the size of the apparatus as a whole. Since air flow formed in the apparatus is most effectively used, an effective use of the space in the apparatus becomes possible accordingly.

In the arrangement of the present invention, it is preferable to use the first and second air flow channels independently of each other. However, as mentioned above, the two channels may be used also simultaneously so long as it does not reduce the efficiency of air flow extremely. For example, in such type of apparatus in which a primary latent image is repeatedly reformed every modulation, only the first channel may be used when the primary latent image is formed and thereafter the first and second channels may be used at the same time.

The structure of screen and the method of latent image forming are by no means limited only those as particularly shown and described in the above embodiments. Also, the type of machine to which the present invention is applicable is not limited only to the copying machine. The present invention is applicable to a recording apparatus using a screen and other similar apparatus without prejudice. While a rotary switching valve has been particularly shown and described as switching means, it is to be understood that any other type of switching means hitherto suitably used for switching over air flow channel such as a slide valve may be used within the scope of the invention.

To make use of back pressure at the suction side in the apparatus, a suction box for separating means and a duct for producing an air flow flowing from the screen toward corona dischargers have been particularly illustrated in the above embodiments. However, for the same purpose, a suction duct may be disposed in the vicinity of developing means which serves to suck developer particle scattered from the developing means. Also, an advantageous arrangement may be obtained when the suction side of a pumping means is disposed within the apparatus opening toward a ozone decomposing or absorbing means and its blow-out side opens to other operation part so as to blow out air free from ozone toward the part. In any case, it should be taken into consideration that the load on a pumping means is increased with the increase of air resistance at either side of its suction and blow.

Thus, it will be understood that the present invention enables for an image forming apparatus of the type in which image forming is effected employing a screen type photosensitive medium to operate in a preferable and more effective manner. The prevention of screen contamination during corona discharging for the screen, the separation of sheet material such as copying or recording sheet at a high speed operation, the decomposition of ozone produced in a larger amount with the increase of operation speed due to the increased corona discharge from dischargers and cooling the overheated part of the apparatus all of which require an air flow more or less can be done very effectively in accordance with the invention. Moreover, according to the invention, for all of these operational objects there is required only one single pumping means. This means a considerable reduction of noise and of manufacturing cost of apparatus.

I claim:

1. An image forming apparatus employing a screen type photosensitive medium, the apparatus comprising:

a corona discharge generating means disposed opposite the screen to form a primary electrostatic latent image thereon;

first and second air flow channels provided within the image forming apparatus;

an air blowing means for forming an air flow in said air flow channels; and a switching means for selectively switching over the air flow to the first channel or to the second channel, said first air flow channel including therein said switching means and extending between the vicinity of the screen and the air blowing means and said second air flow channel including therein said switching means and extending between a mechanism using air and the air blowing means, so that when a primary electrostatic latent image is formed on the screen there is formed an air flow in the direction from the screen toward the corona discharge generating means by way of the first air flow channel, whereas after forming the primary latent image, said switching means directs the air flow to another air using means through the second air flow channel.

2. An image forming apparatus as claimed in claim 1, wherein said another air using means is a suction box disposed for a separating means.

3. An image forming apparatus as claimed in claim 1, wherein said another air using means is an air blowing part for a separating means.

4. An image forming apparatus as claimed in claim 1, wherein said another air using means is an ozone removing means.

5. An image forming apparatus as claimed in claim 1, wherein said another air using means is a suction duct means disposed for preventing developer from scattering.

6. An image forming apparatus employing a screen type photosensitive medium, the apparatus comprising:

a corona discharge generating means disposed opposite the screen to form a primary electrostatic latent image thereon:

first and second air flow channels provided within the image forming apparatus;

an air blowing means for forming an air flow in said air flow channels; and first and second switching means for selectively switching over the air flow to the first channel or to the second channel, said first air flow channel extending from the first switching means to the air blowing means and further from the second switching means to the vicinity of the screen and said second air flow channel extending from a suction mechanism part to the first switching means and further up to the second switching means through the air blowing means, so that when a primary electrostatic latent image is formed on the screen there is formed an air flow in the direction from the screen toward the corona discharge generating means by way of the first air flow channel whereas after forming the primary latent image there is formed an air flow through the switching means, under the suction force at the suction mechanism part.

7. An image forming apparatus as claimed in claim 6, wherein said suction mechanism part is a suction box disposed for a separating device.

8. An image forming apparatus employing a screen type photosensitive medium, the apparatus comprising:

a corona discharge generating means disposed opposite the screen to form a primary electrostatic latent image thereon;

first and second air flow channels provided within the image forming apparatus;

an air blowing means for forming an air flow in the air flow channels; and a switching means for switching over the air flow to the first channel or to the second channel selectively while a minor portion of said air flow being left in the other channel, said first air flow channel including therein said switching means and extending between the vicinity of the screen and the air blowing means and said second air flow channel including therein said switching means and extending between a mechanism using air and the air blowing means, so that when a primary electrostatic latent image is formed on the screen there is formed by the major portion of air flow through the first channel an air flow in the direction from the screen toward the corona discharge generating means, whereas after forming the first latent image, said switching means directs the major portion of the air flow to another air using means by way of the second channel while continuing a minor portion of the air flow to the screen at the same time.

9. An image forming apparatus as claimed in claim 8, wherein said switching means is a valve having an opening provided on a part of the valve so that a small and constant amount of air may be flown into the then closed air flow channel through said opening.

10. An image forming apparatus employing a screen type photosensitive medium, the apparatus comprising:

a corona discharge generating means disposed opposing to the screen to form a primary electrostatic latent image thereon;

a shielding means enclosing said screen;

an air using mechanism operative with the aid of air flow motion;

first and second air flow channels provided within the image forming apparatus;

an air blowing means for forming an air flow in the air flow channels; and a switching means for selectively switching over the air flow to the first channel or to the second channel, said first air flow channel including therein said switching means and extending between an opening provided on a portion of said shielding member enclosing the screen and the air blowing means and said second air flow channel including therein said switching means extending between the air using mechanism and the air blowing means, so that when a primary electrostatic latent image is formed on the screen there is formed an air flow in the direction from the screen toward the corona discharge generating means, whereas after forming the first latent image, the switching means directs the air flow to another air using means through the second channel.

* * * * *

UNITED STATES PATENT OFFICE

CERTIFICATE OF CORRECTION

Patent No. 4,154,521 Dated May 15, 1979

Inventor(s) HIDETOSHI TANAKA

It is certified that error appears in the above-identified patent and that said Letters Patent are hereby corrected as shown below:

In the Abstract, line 13, "also includes" should be added after "second channel";

Column 4, line 29, after "in" insert --whereas in--;

Column 11, line 8, "drawings" should read --drawing--;

Column 16, lines 28 and 29, "opposing to" should read -- opposite --.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*